United States Patent [19]
Elflein
[11] 4,208,901
[45] Jun. 24, 1980

[54] RIVET TONGS

[75] Inventor: Lorenz Elflein, Bad Neustadt, Fed. Rep. of Germany

[73] Assignee: Firma Alfred Honsel, Nieten - und Metallwarenfabrik, Fed. Rep. of Germany

[21] Appl. No.: 848,364

[22] Filed: Nov. 3, 1977

[30] Foreign Application Priority Data

May 27, 1977 [DE] Fed. Rep. of Germany ..... 2724225

[51] Int. Cl.² ..... B21J 15/34
[52] U.S. Cl. ..... 72/391
[58] Field of Search ..... 72/391; 29/243.53, 243.54

[56] References Cited

U.S. PATENT DOCUMENTS

| | | | |
|---|---|---|---|
| 3,154,210 | 10/1964 | Elliott | 72/391 |
| 3,302,444 | 2/1967 | Elliott | 72/391 |
| 3,359,778 | 12/1967 | Di Maio | 72/391 |
| 3,596,496 | 8/1971 | La Pointe | 72/391 |
| 3,955,395 | 5/1976 | Vecchione | 72/391 |
| 4,027,556 | 6/1977 | Klein | 72/391 |
| 4,088,004 | 5/1978 | Di Maio | 72/391 |

*Primary Examiner*—Daniel C. Crane
*Assistant Examiner*—Gene P. Crosby
*Attorney, Agent, or Firm*—Christie, Parker & Hale

[57] ABSTRACT

A rivet tong device for the setting of blind rivets that are provided with tear pins is disclosed. The device includes a pair of legs adapted for pivotal movement about a common axis, retaining means for receiving a rivet and rivet clamping means comprising first and second clamping elements. The second clamping element is formed of a portion of a circular disk such that upon actuation the first and second clamping elements approach one another so as to grip the tear pin and to be moved away from the retaining means so as to tear off the tear pin. The clamping elements are also mounted for pivotal movement about the pivot axis of the legs.

16 Claims, 10 Drawing Figures

RIVET TONGS

Figure 1:
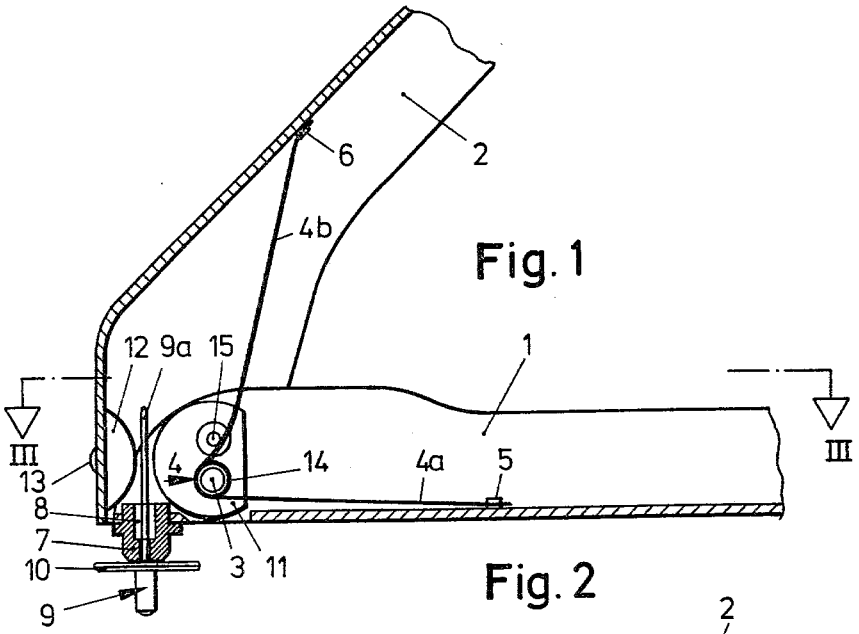

This invention relates to rivet tongs for the setting of blind rivets provided with tear pins, said rivet tongs comprising two legs adapted for pivotal movement about a common pivot axis located intermediate the ends thereof, retaining means for receiving a rivet, and clamping means for said tear pin, said clamping means comprising clamping elements adapted on actuation of said tongs to approach one another so as to grip said tear pin and to be moved away from said retaining means so as to tear off said tear pin.

Rivet tongs of this type are known from German Utility Model No. 6,607,260. The clamping means thereof consists of a chuck mechanism including conical clamping jaws and adapted on actuation of said legs of said tongs to be displaced within a housing relative to said rivet retaining means so as to cause said clamping jaws to grip, retract, and tear off said tear pin. A clamping means of this type is expensive to produce, since the chuck mechanism in addition to said conical clamping jaws requires complementary conical surfaces within said housing as well as a return spring assembly, all of these parts having to be machined and assembled with a high degree of accuracy.

Also known are blind rivet tongs of sophisticated construction including a clamping means also comprising conical clamping jaws, complementary conical configurations within a housing, and return spring means, with hydraulic or pneumo-hydraulic actuating means being additionally provided for actuating said clamping means, said actuating means being operative to transmit the pivotal movement of a manually actuated lever relative to a handle member to said clamping means. All of these blind rivet tongs are expensive as to their construction, and also heavy and unwieldy due to the required housings and their numerous component parts.

It is an object of the invention to provide rivet tongs of the above described type, such rivet tongs being of inexpensive construction, easy to handle and durable in use.

In order to attain this object, the invention provides that the clamping elements are adapted for pivotal movement about the pivot axis of said tongs' legs.

In the rivet tongs according to the invention, the clamping elements are pivoted towards one another into a clamping position. On further pivotal movement of the tongs' legs, and thus of the clamping elements, the tear pin is pulled up, optionally along a curved path, and finally torn off. The clamping elements do not require a separate housing or any sophisticated actuating mechanism for converting the pivotal movement of the tongs' legs relative to one another into a linear pull movement. The clamping elements may be directly attached to each of the tongs' legs, so that assembly is simple and inexpensive. This feature furthermore results in the rivet tongs being of low weight and easy to handle. The simple construction of the rivet tongs furthermore ensures reliable operation and an extended service life.

The relative movement of the clamping elements with respect to one another during pivotal movement of the tongs' legs requires three functionally different phases: approaching one another for gripping the tear pin, pulling said tear pin for setting the rivet, and a jerking movement for tearing off the tear pin. This sequence of movements may be accomplished in a simple manner, i.e. with clamping elements of a simple shape, by the provision that at least one clamping element is mounted on one leg for eccentric movement relative to the pivot axis. In combination with a uniformly shaped linear or curved gripping surface, such eccentric movement results in different displacement paths and speeds relative to the other clamping element. This results in the formation of the clamping elements to be particularly simplified.

The movable clamping element may have associated therewith a back-up spring for biasing said movable element towards the other clamping element, said spring being operative to support the movable clamping element in its desired position and to control the exerted gripping pressure.

In a preferred, particularly simple embodiment, a return spring for biasing the tongs' legs apart from one another may engage the eccentric clamping element for supporting it. This twofold function of the spring enables a further component part to be saved, particularly a component part that would otherwise require frequent replacement due to the occurrence of fatigue.

Figure 2:
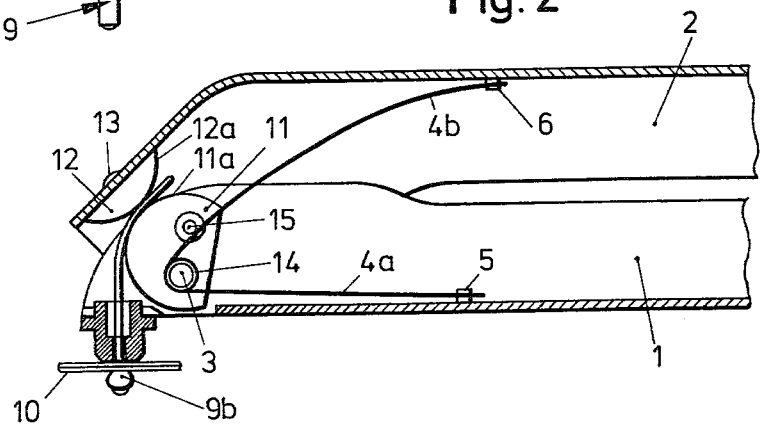
Figure 3:
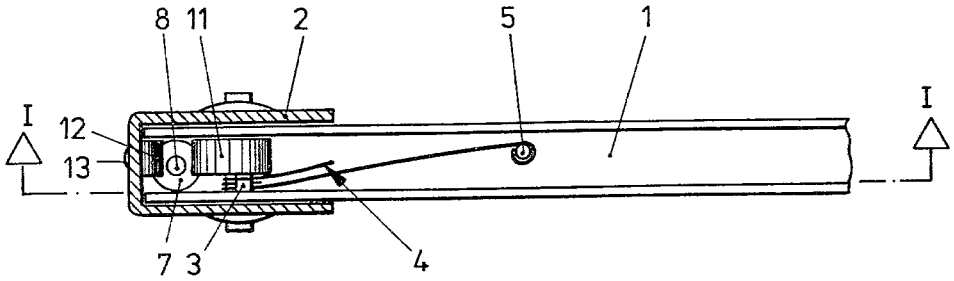
Figure 4:
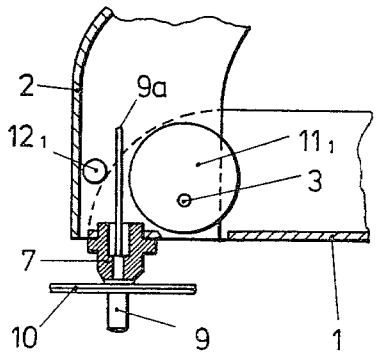
Figure 7:
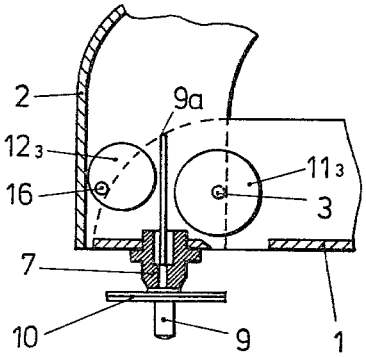
Figure 5:
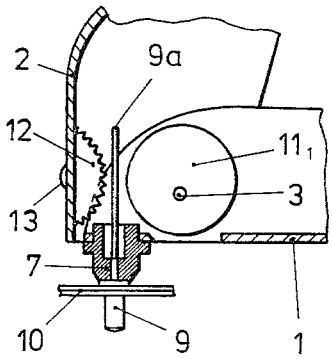
Figure 8:
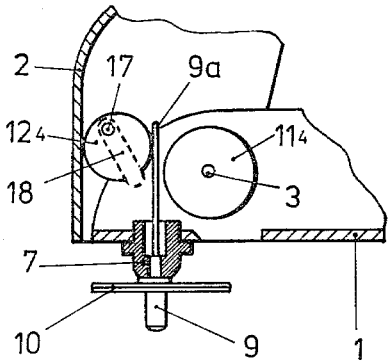
Figure 6:
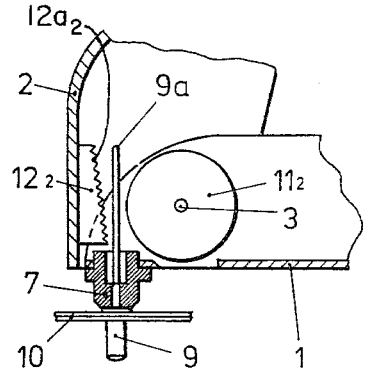
Figure 9:
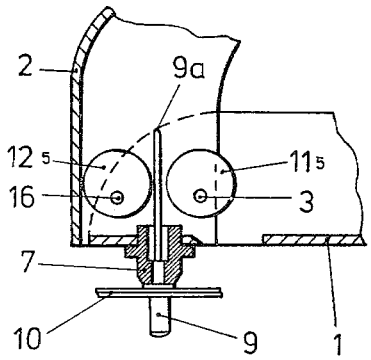
Figure 10:
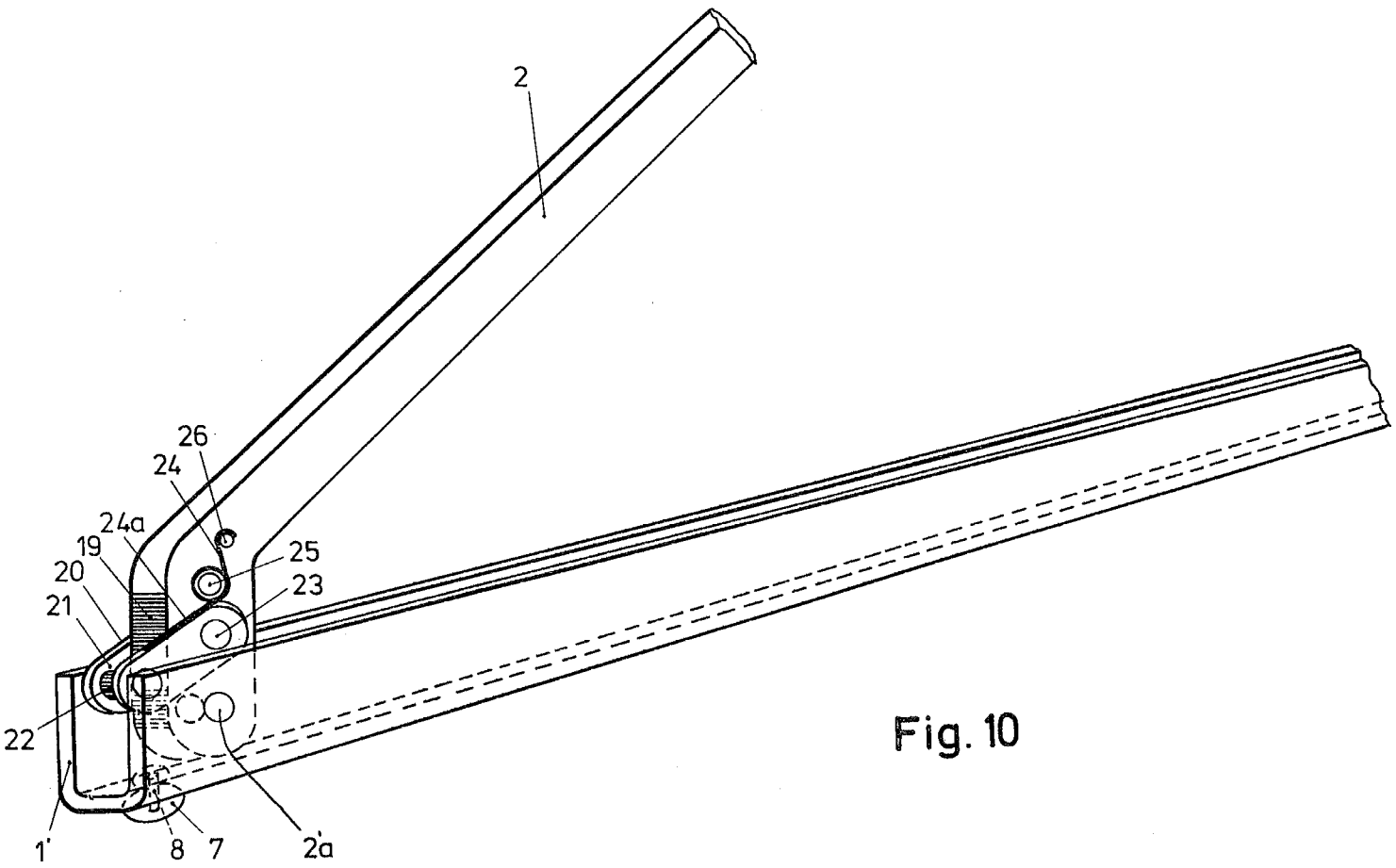

Further characteristics of the inventions, its operation and advantages will become evident from the following description of exemplary embodiments with reference to the drawings. In the drawings:

FIG. 1 shows rivet tongs in the open position in a longitudinal sectional view taken along the line I—I in FIG. 3, FIG. 2 shows the rivet tongs of FIG. 1 in another operative position, FIG. 3 shows the rivet tongs of FIG. 1 in a sectional view taken along the line III—III in FIG. 1, FIG. 4 shows schematically a partial view of rivet tongs in another embodiment, FIG. 5 shows a partial view corresponding to FIG. 4 of rivet tongs in still another embodiment, FIG. 6 shows a further embodiment, FIG. 7 shows a still further embodiment, FIG. 8 shows another embodiment, FIG. 9 shows still another embodiment, and FIG. 10 shows a perspective sectional view of a further embodiment of rivet tongs.

Rivet tongs shown in FIGS. 1 to 3 mainly consist of two tongs' legs 1 and 2 pivotally interconnected by a pivot axle 3. As shown in FIG. 3, each leg 1, 2 is of U-shaped cross-section, with leg 2 being somewhat larger so as to straddle leg 1 on the outside thereof. Pivot axle 3 supports a hairpin spring 4 having one of its legs 4*a* connected to leg 1 by pin 5 and the other leg 4*b* connected to leg 2 by pin 6 so as to bias tongs' legs 1, 2 to their open position shown in FIG. 1. Tongs' leg 2 has its end portion adjacent the pivot axis bent at an obtuse angle so as to extend substantially vertically to leg 1 in the open position. The side walls of leg 1 are rounded at the end portion thereof projecting beyond the pivot axis. The bottom wall of leg 1 supports a retaining member 7 having a bore 8 for receiving the tear pin 9*a* of a blind rivet 9. FIGS. 1 and 2 as well as FIGS. 4 to 10 additionally show two sheet metal members 10 to be fastened to one another by rivet 9.

Clamping means for tear pin 9*a* comprises a clamping element 11 movably connected to first leg 1 and a clamping element 12 rigidly fastened to second leg 2. Both clamping elements 11 and 12 are formed as circular sectors of a disk having a knurled periphery, clamping element 11 having a curved peripheral edge 11*a* extending over more than a half circle, whereas curved peripheral edge 12*a* of second clamping element 12 is shorter than a half circle. Second clamping element 12 has a linear edge portion engaging the bottom wall of second leg 12 and is fastened thereto by fastening element 13. First clamping element 11 is formed with a bore 14 at an eccentric position with respect to the center of its circular edge, and is supported by said bore on pivot axle 3. First clamping element 11 further carries a stop pin 15 extending in spaced relation to bore 14 parallel to the pivot axis and engaged by spring leg **4*b* at least in the open position (FIG. 1**).

For setting a blind rivet, clamping means 11, 12 functions in the following manner: In the open position (FIG. 1), edge portions **11*a*, 12*a* of clamping elements 11 and 12 are spaced at a sufficient distance from one another to receive a tear pin 9*a* therebetween. On closing of the rivet tongs by pivoting legs 1 and 2 towards one another, the arcuate edge portions of the two clamping elements approach one another so that the tear pin is clamped therebetween and is bent around arcuate edge 11*a* of clamping element 11 by second clamping element 12, as shown in FIG. 2. Knurling of edge portions 11*a*, 12*a* as shown in FIG. 3 is provided for increasing the friction. Pivoting of legs 1, 2 causes spring 4 to be tensioned, simultaneously resulting in spring leg 4*b* separating from stop pin 15. The frictional force between the tear pin and first clamping element 11 caused by the pressure on tear pin 9*a* exerted by second clamping element 12 tends to turn first clamping element 11 about its support on pivot axle 3. This causes a tension force to be exerted on tear pin 9*a*, resulting in the formation of a rivet counterhead 9*b* as shown in FIG. 2, and finally in rupture of tear pin 9*a* at its rated breaking point. The torn-off tear pin may then drop from between legs 1 and 2. On release of the tongs' legs by the operator, spring 4 returns legs 1 and 2 to the open position, with spring leg 4*b* again engaging and supporting the stop pin of first clamping element 11** preparatory to setting a further rivet.

FIGS. 4 to 9 show portions of rivet tongs adjacent the pivot axis thereof comprising various embodiments of the clamping means. In the following, only the differences between these embodiments and that of FIGS. 1 to 3 shall be described, with the tongs' legs, the pivot axle, the rivet retaining means and the rivet itself being designated by the same reference numerals in these figures. The support spring for a movable clamping element has been omitted in all of these figures for the sake of clearness.

In the clamping means of FIG. 4, first clamping element $11_1$ is formed as a full-circle disk eccentrically mounted on pivot axle 3. Second clamping element $12_1$ consists of a bolt rigidly fastened to leg 2 with its axis parallel to pivot axle 3. The function of this embodiment is similar to that described with reference to FIGS. 1 to 3. In this instance, however, leg 1 is wider than and straddles leg 2.

FIG. 5 shows a clamping means comprising a movable clamping element $11_1$ corresponding to that of FIG. 4 and eccentrically mounted on pivot axle 3 of leg 1, and a second clamping element 12 corresponding to that shown in FIG. 1. This clamping means functions similar to those already described.

The clamping means according to FIG. 6 has its first clamping element $11_2$ associated with leg 1 formed as a full-circle disk centrically mounted for rotation about pivot axle 3. Rigidly fastened to second leg 2 is a wedge-shaped second clamping element $12_2$ having an edge portion $12a_2$ linearly extending at such an angle with respect to the edge of the tongs' leg and, in the open position, to the direction of the inserted tear pin, that the distance between the edge portion $12a_2$ and the tear pin decreases towards the tear pin's end. This inclined position of the edge portion results in the same clamping, friction and tensioning effects on closing of the rivet tongs as in the above described embodiments.

In the clamping means shown in FIGS. 7 to 9, each leg of the rivet tongs carries a movable clamping element. In FIG. 7, first leg 1 carries a clamping element $11_3$ formed as a circular disk centrically mounted on pivot axle 3. The cooperating clamping element $12_3$ is also formed as a circular disk eccentrically mounted for pivotal movement on second leg 2 about an axis 16. Pivotal movement of legs 1, 2 causes axis 16 to move along a circular path about pivot axle 3. In the initial stage of this movement, second clamping element $12_3$ approaches the tear pin so as to bend it into engagement with first clamping element $11_3$. The frictional forces resulting therefrom cause centrically supported clamping element $11_3$ as well as eccentrically mounted clamping element $12_3$ to be rotated so as to exert the tension forces required for the formation of the rivet counterhead and for rupturing the tear pin. Second leg 2 in this case pivots inside first leg 1.

The clamping means of FIG. 8 comprises a first circular and centrically mounted clamping element $11_4$ corresponding to clamping element $11_3$ in FIG. 7. Second clamping element $12_4$ is likewise formed as a circular disk eccentrically mounted by the engagement of a guiding pin 17 slideably mounted in second leg 2 in guiding slots 18 as shown in dotted lines. The operation of this embodiment is similar to that described with reference to FIG. 7.

The clamping means of FIG. 9 comprises two substantially identical clamping elements $11_5$, $12_5$. Both clamping elements are formed as eccentrically mounted circular disks, with first clamping element $11_5$ being mounted on first leg 1 for pivotal movement about pivot axle 3, and second clamping element $12_5$ being pivotable about axis 16 on second leg 2. This embodiment functions in the same manner as described with reference to FIGS. 7 and 8, with the different stages of operation being determined by the positions of the pivot axes relative to one another.

In the embodiment of rivet tongs shown in FIG. 10, legs 1' and 2' as well as the clamping elements are different from those of the above described embodiments. First leg 1' carries the retaining member 7, 8 for the blind rivet (not shown). Adjacent thereto, the U-shape section of first leg 1' has a square end portion, the interior width of which is greater than the exterior width of second leg 2'. Second leg 2' carries both clamping elements. A first clamping element 19 is formed by a forward edge portion of leg 2', said edge portion extending along a circular arc concentric with a bore **2'*a* for the pivot axle 3 and from there substantially vertically to the main longitudinal axis of first leg 1' in the open position of the tongs. This edge portion is knurled. The second clamping element, generally designated 20, is formed as a U-shaped bracket having two lateral straps 21 joined by a knurled cylindrical bolt 22 adjacent one end thereof. The other ends of straps 21 are supported in pivot bearings 23 adjacent both sides of second leg 2'. Clamping element 20 is dimensioned such that its straps are free to move between the sides of second leg 2' and the lateral walls of first leg 1'. A biasing spring 24 has its central portion and one end supported by pins 25** and 26, respectively, on second leg 2', the free end 24a of spring 24 engaging a strap 21 of clamping element 20 so as to bias the latter in the direction of first leg 1'.

The rivet tongs shown in FIG. 10 functions as follows: The biasing force exerted on clamping element 20 by spring 24 is of such magnitude that the tear pin of a blind rivet introduced through retaining member 7 may easily inserted between clamping elements 19 and 20. Pivotal movement of the tongs' legs causes the linear portion of clamping element 19 to press the tear pin against knurled bolt 22, itself biased into engagement with the tear pin by spring 24. The positioning of the clamping elements relative to one another automatically causes the clamping force exerted on the tear pin to increase on further pivotal movement of the legs towards one another. At the same time, the arcuate forward edge portion of the second leg 2' comes into engagement with the tear pin to exert thereon the tension force required for forming the rivet counterhead and for rupturing the tear pin.

The invention is not restricted to the embodiments shown. These rather constitute only a selection among various shapes, mounting arrangements and assemblies of clamping elements adapted to be brought into cooperation by pivotal movements.

I claim:

1. Rivet tongs for the setting of blind rivets provided with tear pins, said rivet tongs comprising two legs adapted for pivotal movement about a common pivot axis located intermediate the ends thereof, retaining means for receiving a rivet, and clamping means comprising first and second clamping elements, the second clamping element comprising at least a portion of a circular disk, said disk having a circular arcuate edge, the first clamping element and the at least a portion of a circular disk being adapted on actuation of said tongs to approach one another so as to grip said tear pin and to bend it around the circular arcuate edge of said circular disk portion and to be moved away from said retaining means so as to tear off said tear pin, both said first and second clamping elements being mounted for pivotal movement about the pivot axis of said legs.

2. Rivet tongs according to claim 1, characterized in that at least one of the clamping elements is mounted on a leg for eccentric movement about or on said pivot axis.

3. Rivet tongs according to claim 1, characterized in that one of said clamping elements has associated therewith a support spring biasing said element towards said other element.

4. Rivet tongs according to claim 3, characterized in that a hairpin spring biasing said legs away from one another forms the support spring, said spring for providing a separating force to open the tong handles after a tear pin has been ruptured and for engaging the second clamping element when the tong handles are opened.

5. Rivet tongs according to claim 1, characterized in that said second clamping element is connected to one leg and said first clamping element is rigidly connected to the other leg.

6. Rivet tongs for the setting of blind rivets provided with tear pins, said rivet tongs comprising two legs adapted for pivotal movement about a common pivot axis located intermediate the ends thereof, retaining means for receiving a rivet, and clamping means comprising first and second clamping elements, each of the clamping elements comprise at least a portion of a disk having cooperating edge portions adapted on actuation of said tongs, to approach one another so as to grip said tear pin and to be moved away from said retaining means so as to tear off said tear pin, characterized in that both said first and second clamping elements are mounted for pivotal movement about the pivot axis of said legs.

7. Rivet tongs according to claim 6, characterized in that said second clamping element has a circular arcuate edge portion.

8. Rivet tongs according to claim 6, characterized in that said first clamping element has a circular arcuate edge portion.

9. Rivet tongs according to claim 1, characterized in that said first clamping elemnet has a linear edge portion.

10. Rivet tongs according to claim 1, characterized in that said first clamping element is formed as a bolt.

11. Rivet tongs according to claim 1, characterized in that each of said legs mounts a clamping element to be eccentrically moveable thereon.

12. Rivet tongs according to claim 1, characterized in that said first clamping element is eccentrically mounted on guide means.

13. Rivet tongs according to claim 1, characterized in that said clamping elements are each provided with a knurled edge portion along the portion thereof which grips said tear pin.

14. Rivet tongs for the setting of blind rivets provided with tear pins, said rivet tongs comprising two legs adapted for pivotal movement about a common pivot axis located intermediate the ends thereof, retaining means for receiving a rivet, and clamping means comprising first and second clamping elements, the second clamping element comprising at least a portion of a disk, the first clamping element and the at least a portion of a disk being adapted on actuation of said tongs to approach one another so as to grip said tear pin and to be moved away from said retaining means so as to tear off said tear pin, characterized in that both said first and second clamping elements are mounted for pivotal movement about the pivot axis of said legs and both of said clamping elements are formed as disks having cooperating edge portions.

15. Rivet tongs according to claim 14 characterized in that said second clamping element has a circular arcuate edge portion positioned for engagement with a tear pin positioned between the first and second clamping elements.

16. Rivet tongs for the setting of blind rivets provided with tear pins, said rivet tongs comprising two legs adapted for pivotal movement about a common pivot axis located intermediate the ends thereof, retaining means for receiving a rivet, and clamping means comprising first and second clamping elements adapted on actuation of said tongs to approach one another so as to grip said tear pin and to be moved away from said retaining means so as to tear off said tear pin, characterized in that both said first and second clamping elements are mounted for pivotal movement about the pivot axis of said legs, each of said clamping elements being eccentrically and movably mounted for movement on a different one of said legs.

* * * * *